US005505864A

United States Patent [19]

Bauer et al.

[11] Patent Number: 5,505,864

[45] Date of Patent: Apr. 9, 1996

[54] TANNING AGENT CONTAINING A DIALDEHYDE

[75] Inventors: Harald Bauer, Weiterstadt; Juergen Christner, Seeheim-Jugenheim; Gertrud Wick, Darmstadt, all of Germany

[73] Assignee: Röhm GmbH, Darmstadt, Germany

[21] Appl. No.: 167,561

[22] Filed: Dec. 14, 1993

[30] Foreign Application Priority Data

Dec. 14, 1992 [DE] Germany ..... 42 42 076.8

[51] Int. Cl.[6] ..... C14C 3/22

[52] U.S. Cl. ..... 252/8.57; 8/94.33; 8/94.21; 8/94.18

[58] Field of Search ..... 252/8.57; 8/94.33, 8/94.21, 94.18; 427/389

[56] References Cited

U.S. PATENT DOCUMENTS

| | | | |
|---|---|---|---|
| 2,205,883 | 6/1940 | Graves | 8/94.33 |
| 2,941,859 | 6/1960 | Fein et al. | 8/94.33 |
| 3,291,558 | 12/1966 | Bader et al. | 8/94.21 |
| 3,945,792 | 3/1976 | Wurmli et al. | 8/94.21 |
| 3,966,551 | 6/1976 | Monsheimer et al. . | |
| 3,986,926 | 10/1976 | Monsheimer et al. . | |
| 4,439,201 | 3/1984 | Lauton et al. | 8/94.33 |
| 4,443,221 | 4/1984 | May et al. | 8/94.33 |
| 5,011,499 | 4/1991 | Rathfelder et al. | 8/94.33 |
| 5,286,263 | 2/1994 | Schaffer et al. | 8/94.33 |

FOREIGN PATENT DOCUMENTS

| | | |
|---|---|---|
| 118213 | 12/1984 | European Pat. Off. . |
| 0118213 | 12/1984 | European Pat. Off. . |
| 2423118 | 11/1975 | Germany . |
| 3811267 | 5/1989 | Germany . |
| 1520068 | 11/1989 | U.S.S.R. . |
| 1465453 | 2/1977 | United Kingdom . |

*Primary Examiner*—Prince Willis, Jr.
*Assistant Examiner*—Alan D. Diamond

[57] ABSTRACT

Tanning agents containing an ω,ω-dialdehyde as as the active tanning substance, optionally in a deactivated form, in combination with a polymer containing hydroxyl groups, and methods for using such tanning agents in the preparation of leather, particularly in pickling, tanning, and retanning.

6 Claims, No Drawings

TANNING AGENT CONTAINING A DIALDEHYDE

FIELD OF THE INVENTION

The present invention pertains to tanning agents which contain an ω,ω'-dialdehyde as the active tanning substance, in combination with a polymer containing hydroxyl groups, as well as to a method of tanning using the combination tanning agent.

DESCRIPTION OF THE RELATED ART

For a long time, tanning technology has concerned itself with alternatives to chrome tannage which, to be sure, produces outstanding leathers (chrome leathers), but which is ecologically questionable. (cf. Kirk-Othmer, *Encyclopedia of Chemical Technology,* 3rd edition, vol. 14, pp. 200–231, pp. 226 ff., J. Wiley 1981; Ullmann's *Encyclopedia of Industrial Chemistry,* 5th edition, vol. A15, pp. 259–282, VCH 1990). In the chrome tannage process heretofore used in practice, chromium salts in an amount of 1.5–2.5 percent of chromium-III-oxide, based on the weight of unhaired hides, are added to achieve a leather stable to boiling. A portion of the added chromium salt is not bound by the skin tissue and thus as a rule is found in the waste water. To be sure, with modern methods for treating waste water the chromium can be removed by chemical precipitation. However, the settled sludge so formed must be brought to a special waste disposal site. Disposal of the leather shavings formed on leveling the chrome treated leather also presents a problem.

A tanning free of chromium or using little chromium can, for example, also be carried out using aldehydes as tanning agents (so-called aldehyde tanning, cf. Kirk-Othmer loc. cit.; F. Stather, *Gerbereichemie und Gerbereitechnologie,* Akademie-Verlag, Berlin 1967). In addition to formaldehyde, aliphatic dialdehydes, particularly glutardialdehyde and succinic dialdehyde, have been used, though primarily for pretanning, i.e. followed by other tanning methods such as chrome tannage, and for retanning. The basic cause for the tanning effect of aldehydes is assumed to be a reaction with the primary amino groups of the lysine side chain of proteins, which leads to crosslinking (cf. Kirk-Othmer, loc.cit.), wherein the mechanism seems to occur in more complex detail than expected. [Cf. M. K. Meek et al., J. Mol Biol. 185, 359 (1985); T. Tashima et al., Chem. Pharm. Bull. 35, 4169 (1987)]. The amounts of pure glutardialdehyde necessary for a pretanning—about 0.5 to 1 percent by weight of the unhaired hides—are comparatively small.

The crosslinking effected by glutaraldehyde is extremely stable to hydrolysis. When pure glutaraldehyde is used in pretanning, difficulties are often encountered because of the non-uniform penetration in the cross-section of the pickled unhaired hides; consequently, the edge regions are more strongly crosslinked than the middle layer. Thus, in practice, lower shrinkage temperatures are observed in the middle layers than in the edge regions.

DE-C 38 11 267 proposes a method for the preparation of semi-fabricated leather in which a reversibly inactivated $C_2$–$C_8$-ω,ω'-dialdehyde is added as a tanning-active agent having high penetrating properties. Deactivation occurs by the addition of 0.2 to 4.0 mol of an hydroxy compound of the formula $$R\text{-}O\text{-}[\text{-}(C_2H_4O)_x\text{-}(C_3H_6O)_y\text{-}(C_4H_8O)_z]_nH,$$

wherein n stands for 0 to 10, x+y+z stands a whole number from 1–20, and R stands for hydrogen (if n is not equal to 0) or $C_1$–$C_{12}$-alkyl, optionally substituted with one or more hydroxyl groups. Of course, even a deactivation of the glutardialdehyde as described in DE-C 38 121 267 is not unequivocally effective. To be sure, better diffusion of the glutardialdehyde and hence a more uniform shrinkage temperature throughout the cross section is achieved, but on chromium-poor retanning a different uptake of chromium in the hide cross section results. The edge zones show a lower chromium content than the middle layer. This has the result that leathers retanned in this way can only be badly trimmed. Numerous references to the use of acrylate-(Co)-polymers as synthetic tanning agents (syntans), particularly in combination with chromium tanning, are found in the literature [cf. W. C. Prentiss et al., J. An. Leather Chem. Assoc. 70, (11) 481–497 (1975); F. J. D. Shortland et al., J. Soc. Leather Technol. Chem., 64, (3) 60–64 (1980)].

A method for preparing leather is known from DE-B 24 23 118 wherein the unhaired hides are treated, alone or in the course of a chrome or a synthetic vegetable tanning, with a tanning active polymer-aldehyde dispersion which is prepared by permitting an aqueous 10–35 percent aldehyde solution and a dispersion comprising acrylate copolymers in a concentration of 10–35 percent mutually to interact. However, this publication concretely shows only the use of a dispersion predominantly comprising ethyl acrylate with small amounts of methacrylic acid (about 0.7 percent) in combination with glutardialdehyde, glyoxal, and formaldehyde.

SUMMARY OF THE INVENTION

Tanning processes using aldehydes, particularly glutaraldehyde—even in modified form—, are subject to disadvantages which weigh in part against their advantages such as relative ecological harmlessness. Thus the task remains to find tanning agents which avoid the disadvantages of the prior use of dialdehydes tanning agents without giving up the advantages described above.

It has now been found that the tanning agents of the invention are able extensively to solve this problem.

DESCRIPTION OF THE PREFERRED EMBODIMENTS

The tanning agents (TA) of the invention consist of the combination of (1) an ω,ω'-dialdehyde of the formula I:

$$O{=}CH\text{-}(CH)_r\text{-}HC{=}O, \qquad (I)$$

wherein r stands for a whole number from 2 to 8, which may optionally be present in deactivated form, with (2) a polymer containing hydroxyl groups which is made from polymerizable vinyl carboxylic acids and polymerizable vinyl monomers containing hydroxyl groups. Preferably the polymers have one of two compositions, wherein the first class of polymers (polymers P-1) are made up of a) 10 to 95, preferably 50 to 90, percent by weight of at least one carboxylic monomer of the formula II:

$$R_2HC{=}C(R_1)\text{-}COOH, \qquad (II)$$

wherein $R_1$ stands for hydrogen, methyl, or a $-CH_2COOH$ group and $R_2$ stands for hydrogen, methyl, phenyl, or a -COOH group (with the proviso that there are not more than two carboxyl groups in the molecule), or for at least one anhydride monomer which is capable of forming carboxyl groups in the presence of water and which has the formula II-A:

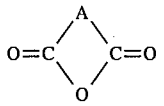

(II-A)

wherein A stands for the group

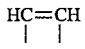

or for the group

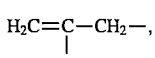

and b) 0 to 90, preferably 10 to 50, percent by weight of at least one hydroxylic monomer, of the formula III:

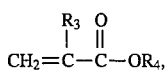

(III)

wherein $R_3$ stands for hydrogen or methyl and $R_4$ stands for an alkyl or cycloalkyl group having 1 to 12 carbon atoms which is substituted with at least one hydroxyl group, and c) 0 to 90, preferably 10–50 percent, by weight of at least one allyloxy ester monomer of the formula IV:

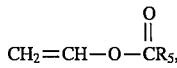

(IV)

wherein $R_5$ stands for an alkyl group having 1 or 2 carbon atoms, and d) 0 to 80, preferably 0 to 50, and particularly 10 to 50, percent by weight of at least one (meth)acrylic acid ester monomer of the formula V:

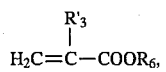

(V)

wherein $R'_3$ stands for hydrogen or methyl and $R_6$ stands for an optionally cyclic alkyl group having 1 to 12, preferably 1 to 8, carbon atoms.

The sum of components a) to d) in polymer P-1 amounts to 100 percent by weight.

The second class of polymers (polymers P-2) has the following composition:

a') 0 to 10, preferably 0 to 5, percent by weight, of at least one carboxylic monomer of the formula II:

$$R_2HC{=}C(R_1)\text{-}COOH, \quad \text{(II)}$$

wherein $R_1$ stands for hydrogen, methyl, or a $-CH_2COOH$ group and $R_2$ stands for hydrogen, methyl, phenyl, or a -COOH group (with the proviso that there are not more than two carboxyl groups in the molecule), or for at least one anhydride monomer which is capable of forming carboxyl groups in the presence of water and which has the formula II-A:

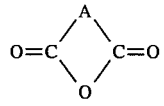

(II-A)

wherein A stands for the group

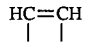

or for the group $H_2C{=}C\text{-}CH_2$-, and b') 0 to 10, preferably 5 to 10, percent by weight of at least one hydroxylic monomer of the formula III:

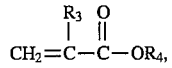

(III)

wherein $R_3$ stands for hydrogen or methyl and $R_4$ stands for an alkyl or cycloalkyl group having 1 to 12 carbon atoms which is substituted with at least one hydroxyl group, and c') 90 to 100, preferably 95 to 100, percent by weight of at least one allyloxy ester monomer of the formula IV:

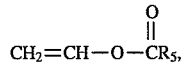

(IV)

wherein $R_5$ stands for an alkyl group having 1 or 2 carbon atoms, as well as d') 0 to 10, preferably 0 to 5, percent by weight of at least one (meth)acrylic acid ester monomer of the formula V:

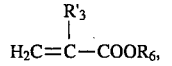

(V)

wherein $R'_3$ stands for hydrogen or methyl and $R_6$ stands for an optionally cyclic alkyl group having 1 to 12, preferably 1 to 8, carbon atoms.

The sum of components a') to d') in polymers P-2 amounts to 100 percent by weight.

In general, the amount of the monomers of formulas III and IV, which contain hydroxyl groups or can release such groups hydrolytically in a polymer-like reaction, can be in the range of 5 to 100 percent by weight based on the polymers P.

In the tanning agents, the ratio between the tanning active ω,ω'-dialdehyde of formula I and the polymer is usually in the range from 1:4 to 4:1, in parts by weight.

The indicated partial deactivation of the aldehyde of formula I, made in the interest of uniform tanning effect, occurs through the hydroxyl functions of the polymer itself, but can be intensified by the addition of one or more alcohols, preferably water soluble alcohols.

Polyvalent alcohols from the group consisting of glycol, glycerin, pentaerythritol, butyl glycol, 1,4-butanediol, polyethylene glycols, polyethylene-polypropylene glycols, as well as sugars and sugar alcohols such as glucose, fructose, and sorbitol are particularly useful. Further, hydroxycarboxylic acids such as glycolic acid are suitable.

In general, these alcohols, if present, are added in a molar ratio of 3.5:1, particularly 1 to 2:1, based on the mols of aldehyde of formula I.

As aldehydes of formula I, glutardialdehyde is particularly preferred as well as succinic dialdehyde.

As monomeric compounds of formula II, (meth) acrylic acid, maleic acid, fumaric acid, and itaconic acid are particularly mentioned, optionally also in admixture. As compounds of formula II-A, maleic acid anhydride and itaconic acid anhydride are named.

As monomers of formula III containing hydroxyl groups, particularly those having terminal -OH groups, hydroxyethyl acrylate and methacrylate, 3-hydroxypropyl acrylate and methacrylate, 4-hydroxybutyl acrylate and methacrylate, as well as monoacrylates or monomethacrylates of polyols, such as, for example, glycerin monoacrylate and methacrylate and neopentyl acrylate and methacrylate are given as examples.

As compounds of formula IV, vinyl acetate and vinyl propionate come particularly into consideration.

As monomers of formula V, methyl methacrylate and methyl acrylate, ethyl acrylate, as well as ethylhexyl acrylate and ethylhexyl methacrylate are particularly mentioned.

The polymers P to be used according to the invention have a mol mass in the range from 1000 to 50,000, particularly less than 5000, g/mol. The determination of mol mass is done by means of size exclusion chromatography (S. E. C.) [cf. H. F. Mark et al., *Encyclopedia of Polymer Science & Engineering,* 2nd edition, vol. 10, pp. 1–18, J. Wiley (1987); Ullmann's *Encyclopedia of Industrial Chemistry,* 5th edition, vol. 20A, pp. 563–568, VCI (1992) ].

In the preferred aqueous formulation, the tanning agents usually have a content of polymer P-1 or P-2 of 10–60, preferably 20–40, percent by dry weight.

The tanning agents, as aqueous formulations, have a pH value in the range from 0.5 to 5, preferably 2 to 4.

Polymers P can be prepared in a known fashion by free radical polymerization of the monomers of formulas I - V in the desired proportions (cf. H. Rauch Puntigam, Th. V ölker, *Acryl-und Methacrylverbindungen,* Springer Verlag 1968).

Because of the content in polymers P of hydrophilic monomers (monomers of the formulas II or III), carrying out the polymerization as a solution polymerization is recommended.

For this, one operates in an aqueous phase with addition of water soluble accelerators, wherein in general the concentration of the monomers is kept below 25 percent by weight because the reaction is exothermic. To reduce the molecular weight, use can be made of the known chain transfer agents, particularly sulfur chain transfer agents, especially water soluble chain transfer agents such as mercaptoethanol or thioglycolic acid, or optionally allyl alcohol. The content of initiator is in general in the range from 0.01 to 1 percent by weight based on the monomers.

Redox systems known in the art are particularly preferred as initiators, for example those containing heavy metal ions, for example iron ions, in combination with water soluble per-compounds such as hydrogen peroxide or persulfate.

The polymerization can be carried out to advantage as a two stage batch polymerization in a suitable reaction vessel. For example, half of the monomers are put into the aqueous phase, optionally together with the reducing component of the initiator at room temperature, wherein an about 3-fold to 3.5-fold amount of water can be used. The polymerization is then started by addition of the per-compound, e.g. 30 percent aqueous hydrogen peroxide solution (perhydrol). Thereafter, the temperatures rises, for example to about 80° C. After reaching the maximum temperature, the batch is cooled, for example to 35° C., and the complete charge of the second stage, usually consisting of the second half of the monomers and the chain transfer agent or the reducing agent, is added and the reaction is started by renewed addition of about the same amount of per-compound, whereupon the temperature again rises, for example to 85° C. After reaching the maximum temperature, the batch is suitably stirred for an additional hour and then cooled. Advantageously, the products of the method can be used in the liquid phase, i.e. without isolation of the polymers P.

Performance of the Tanning Method

The invention further pertains to a tanning method using the tanning agent of the invention. One suitably proceeds following the state of the art. As a rule, one starts with unhaired hides ready for tanning, as obtained after conclusion of the method steps of the beamhouse. (Cf. Kirk-Othmer, *Encyclopedia of Chemical Technology,* 1st edition, vol. 16, pp 109–147,J. Wiley. One can start from green or salt-preserved goods. The beamhouse typically includes the steps of a) washing, b) soaking, c) liming, d) deliming and bating, and e) pickling. Paddle vats, drums, or tanning machines can be used as containers. For example, unhaired hides prepared according to U.S. Pat. No. 3,986,926 or U.S. Pat. No. 3,966,551 can serve as starting materials. The method of the invention can advantageously be carried out as a pickle, for example in the treatment of cowhides. For this, the tanning agent of the invention is added to hides present in a float adjusted to an acid pH range (initial guide value 2.2–2.5) with an acid causing little swelling, such as formic acid, and is left to act for some time, for example over night, with stirring at suitable intervals. Usually the float is 50 to 100 percent of the weight of the unhaired hides. Advantageously, the float is then treated with sodium bicarbonate and sodium bisulfite, for example over a period of about 2 hours. The so called shaved wet-whites can be retanned in a known fashion, for example α) by chrome tanning β) by vegetable tanning, or γ) by synthetic tanning.

For the retanning method described below, proceeding in a tanning vat is recommended. Chrome retanning of the chrome free pretanned leather can be undertaken, for example, by treating the goods, e.g. trimmed wet-whites, in a chrome tannage float—usually 150 to 250 percent of the trimmed weight—suitably over night. According to a typical procedure, the goods can be briefly agitated in a float brought to a pH value of about 3.5 with formic acid, followed by renewed agitation for about ½ hour with addition of chrome tanning agent (as content: about 25 percent by weight $Cr_2O_3$, 33 percent by weight basicity). Then fatting agents (for example alkyl sulfonates) are added and the batch is again agitated for about i hour and then neutralized with magnesium oxide and agitated for about 3 hours. Then a known chrome syntan is added and there is renewed agitation, e.g. for about ¼ hour. Suitably further fatting agent (for example natural sulfinated oils) is added and agitation is again renewed for 120 minutes, for example. The float, which as a rule is at a pH of 4.0–4.2, is left over night with periodic agitation (about 2 minutes of agitation, 30 minutes of standing).

After draining off the float, the batch is treated with about the same amount of float to which about 2 percent by weight of sodium formate is first added and after about 20 minutes of agitation is neutralized by the addition of about 2 percent by weight of sodium bicarbonate with agitation for about an hour, whereby the float reaches a pH value of about 5.5–6.0.

This is advantageously followed by stuffing with about the same float length (for example using natural and synthetic sulfoester derivatives) with agitation, for example over a period of 1½ hours. Then a fixing with diluted formic acid follows with agitation for about ½ hour.

After draining the float, the batch can be washed according to the usual procedure and the leather thrown over a horse, stretched, and dried. The usual finishing of the leather follows. Further variations of chrome tannage can be carried out following H. Herfeld, *Bibliothek des Leders,* vol 3.

Vegetable retanning of the leather which has been pretanned free of chromium can be carried out as follows, for example. The material, e.g. trimmed wet-whites, is first washed, e.g. in a float of about 300 percent of the trimmed weight, containing nonionic surface active and dispersing agents, for example comprising fatty alcohol ethoxylates, with about 20 minutes' agitation. Vegetable tanning follows after draining the float. For this, using a float length of about 100 percent, a system, for example from the group of phenol condensation products, can be added and the batch then agitated for about ½ hour, followed by the addition of a fatting agent, for example of the straight chain hydrocarbon type, with about 20 minutes' agitation. The vegetable tanning agent, for example mimosa tanning agent, is suitably then added in amounts of—as a guide—8 percent of the trimmed weight, with renewed extended agitation, for example for 3 hours.

After renewed addition of the syntan, there is again agitation for about ½ hour and, suitably after adding formic acid, agitation which is first continuous for about ½ hour, then discontinuous over night (about 1 minute of agitation, 10 minutes of rest).

After draining the float, the batch is washed with water, the wash water is drained, and a neutralizing tanning agent, e.g. from the group of salts of organic acids, is added in about 150 percent of water based on the trimmed weight. There is agitation for yet about another ¾ hour, whereby the float usually takes on a pH value in the range from 5.0–5.5, and the float is then drained. Suitably this is followed by a stuffing which can be carried out, for example, with fatting agents from the group of sulfited oils and sulfosuccinic acid esters in about 150 percent of water (based on the trimmed weight). Then, as usual, a fixing with acid, for example formic acid, follows with agitation for about ½ hour, whereby the float is brought to a pH value of 3.5–3.7 (cf. H. Herfeld, *Bibliothek des Leders,* vol. 3, loc.cit.). After washing, one may proceed analogously to the procedural method of chrome free pretanning.

In the synthetic retanning of leather which has been pretanned free of chromium, for example of wet-whites, a washing step like that of the vegetable retanning is introduced. The tanning step follows similarly, in that a suitable syntan, e.g. from the group of phenol condensation products, is added—as a guide about 4 percent of the trimmed weight is mentioned—in about 100 percent of water with about 30 minutes' agitation, followed by the addition of a fatting agent and briefer agitation, about 20 minutes. Then three further portions of the syntan are added—preferably at intervals of about ½ hour, with agitation—so that the total content of syntan is, as a guide value, about 22 percent of the trimmed weight. The batch is then continuously agitated for about 3 hours and further—over night—discontinuously (about in a rhythm: 1 minute's agitation, 20 minutes of rest). A neutralization like that of the vegetable tan follows, however with subsequent addition of further syntan, for example of a further 5 percent by weight, whereby suitably the batch is agitated for about 60 minutes. After draining the float, one can proceed as in vegetable tanning.

The advantage of the method according to the invention lies inter alia in that the dialdehyde of formula I, particularly glutardialdehyde, is deactivated to a desired degree by the organically bound hydroxyl groups present and in this way self-condensation is prevented. It is of particular significance that the polymer, because of the modification brought about by the dialdehyde, penetrates more deeply into the hide cross section and thereby a better complete filling is achieved. Also, with a subsequent chrome-poor retanning, a more uniform distribution of chromium is obtained. The use of the polymers P also leads to a better equalization of color and to better ease of trimming.

EXAMPLES

A. Preparation of the Polymers P

Polymer P-A: Polymer comprising acrylic acid and 2-hydroxyethyl acrylate in a weight ratio of 9:1.

Polymer P-B: Polymer comprising acrylic acid and 2-hydroxyethyl acrylate in a weight ratio of 8:2.

The Preparation of Polymer P-A having a mol mass of about 1200 takes place in a two-stage redox batch.

The entire first stage (7.49 kg of water, 2,097 kg of acrylic acid, 0.233 kg of 2-hydroxyethyl acrylate, 466 g of mercaptoethanol, and 23 g of a 1 percent solution of $FeSO_4$) is put into the reaction vessel and started at room temperature by addition of 585 g of perhydrol (30 percent $H_2O_2$). The temperature climbs to 80° C. After the maximum temperature is reached, the batch is cooled to 35° C. and the complete second stage (2.097 kg of acrylic acid and 0.233 kg of 2-hydroxyethyl acrylate and 466 g of mercaptoethanol) is added and polymerization started anew by the addition of 585 g of perhydrol. The temperature climbs to 85° C. After reaching the maximum temperature the batch is stirred for 1 further hour and then cooled. Polymer P-A is obtain in an aqueous phase and can be used as such.

The preparation of Polymer P-B follows in analogous fashion.

TABLE 1

| Properties of the Polymers P | | | |
|---|---|---|---|
| Polymer | Dry Content (%) | Viscosity | pH |
| P-A | 40 | <50 mPas | 4.0 |
| P-B | 40 | <50 mpas | 3.8 |

B. Preparation of the Tanning Agent

The tanning agents of the invention are obtained by mixing the components, e.g. polymers P, aldehydes of the formulas I, and optionally an alcohol, at room temperature or with brief heating to 50° C. (pH 3–4). Preferably the polymers P are used as they directly arise in polymerization. A summary of the tanning agents tested is given in following Table 2, wherein G=Glutardialdehyde, P=Polymer, and A=Alcohol.

TABLE 2

| Tanning Agent TA | | | |
|---|---|---|---|
| TA Nr. | Glutardialdehye + P, A | Mol Ratio G:A | Weight Ratio P:A |
| I | P-1, butyl glycol | 1:1 | 1:1 |
| II | P-1, butyl glycol | 1:1 | 1:3 |
| III | P-2, butyl glycol | 1:1 | 1:1 |
| IV | P-2, butyl glycol | 1:1 | 1:3 |
| V | P-1, 1,4-butanediol | 1:1 | 1:1 |
| VI | P-2, 1,4-butanediol | 1:1 | 1:1 |

C. Tanning Method

Example C-1: Wet-white Tanning

Starting material: limed and bated cowhides, split thickness 3.3–3.5 mm.

The percentages are based on the weight of unhaired hides.

Pickle:
- 50.0% of water, 22° C.
- 6.0% of salt
  - Agitate for 10 minutes
- \+ 0.6% of formic acid, 85%, diluted 1:5
  - Agitate for 90 minutes
  - Float: pH 2.2–2.5
  - Cut: yellow with bromcresol green added as a pH indicator
- \+ x % of product TA-I to TA-VI
  - Agitate for 90 minutes
  - alternately: 2 minutes' agitation : 5 minutes' rest
  - Total treatment time: over night
  - Float: pH 2.7–3.2
- \+ 0.5% of sodium bicarbonate
- 0.2% of sodium bisulfite
  - Agitate for 120 minutes
  - Float pH 3.9–4.4
  - Drain float Put wet-whites on horse, sammy, and trim.
These wet-whites can be retanned in 3 ways:
- chrome tanning (Example C-2)
- vegetable tanning (Example C-3)
- synthetic tanning (Example C-4)

Example C-1a: Chrome-free Pretanning

Starting material: limed and bated cowhides, split thickness: 3.3–3.5 mm.

The percentages are based on the weight of the unhaired hides.

Pickle:
- 50.0 % of water, 22° C.
- 6.0% of salt
  - Agitate for 10 minutes
- \+ 0.6% of formic acid, 85%, diluted 1:5
  - Agitate for 90 minutes
  - Float: pH 2.2–2.5
  - Cut: yellow with bromcresol green added as a pH indicator
- \+ x % of products TA-I to TA-VI (see Table 3)
  - Agitate for 90 minutes
  - alternately: 2 minutes' agitation 5 minutes' rest
  - Total treatment time: over night
  - Float: pH 2.7–3.2
- \+ 0.5% of sodium bicarbonate
- 0.2 % of sodium bisulfite
  - Agitate for 120 minutes
  - Float: pH 3.9–4.4
  - Drain float Put wet-whites on horse, sammy, and trim.
The trimmed wet-whites can be retanned in three ways:
- chrome tanning (Example C-2)
- vegetable tanning (Example C-3)
- synthetic tanning (Example C-4)

Example C-2: Chrome Tanning

Leather type: light top leather
Starting material: trimmed wet-white, 1.4–1.5 mm
The percentages are based on the trimmed weight.

Tanning:
- 200.0% of water, 15° C.
- 0.3% of formic acid, 85%, diluted 1:3
  - Agitate for 15 minutes
  - Float: pH 3.4–3.6
- \+ 7.0% of CHROMOSAL ® B, a chrome tanning agent having a defined adjusted basicity (26 percent $Cr_2O_3$, 33 percent basicity)
  - Agitate for 30 minutes
- \+ 3.0% of grease (CHROMOPOL ® SG, an electrolyte resistant tanning grease)
  - Agitate for 60 minutes
- \+ 4.0% of CROMENO BASE ® FN (a basic agent for quenching chrome tanning)
  - Agitate for 240 minutes
- \+ 4.0% of chrome syntan (TANNESCO ®, a phenol sulfonic acid condensation product containing chromium salt)
  - Agitate for 15 minutes
- \+ 6.0% of grease (CHROMOPOL ® SG, a chrome tanning agent having a defined adjusted basicity (26 percent $Cr_2O_3$, 33 percent basicity))
  - Agitate for 120 minutes
  - alternately: 2 minutes' agitation 5 minutes' rest
  - Total treatment time: over night
  - Float: pH 4.0–4.2
  - Drain float.

Neutralization:
- 200.0% of water, 35° C.
- 2.0% of sodium formate
- Agitate for 20 minutes
- \+ 2.0% of sodium bicarbonate
  - Agitate for 60 minutes
  - Float: pH 5.5–6.0
  - Drain float Stuffing:
- 200% of water, 50° C.
- 12.0% of grease (CORIPOL ® MK, a grease especially for very supple clothing leather)
  - Agitate for 90 minutes Fixing:
- \+ 1.5% of formic acid, 85 percent, diluted 1:3
  - Agitate for 30 minutes
  - Drain float Washing, stretching of leather on horse, suspension drying, conventional finishing.

Example C-2a: Chrome Retanning of the Chrome-free Pretanned Leather from Example C-1.

Leather type: light top leather
Starting material: trimmed wet-white, 1.4–1.5 mm
The percentages are based on the trimmed weight.

Tanning:
- 200.0% of water, 25° C.
- 0.3% of formic acid, 85 percent, diluted 1:3
  - Agitate for 15 minutes
  - Float: pH 3.4–3.6
- \+ 7.0% of chrome tanning agent (25% $Cr_2O_3$, 33% basicity)
  - Agitate for 30 minutes
- \+ 3.0% of grease, e.g. alkyl sulfonate
  - Agitate for 60 minutes
- \+ 0.4% of magnesium oxide
  - Agitate for 240 minutes
- \+ 4.0% chromium syntan, e.g. a phenol sulfonic acid condensate containing a chromium salt
  - Agitate for 15 minutes
- \+ 6.0% of grease, e.g. natural sulfited oils
  - Agitate for 120 minutes
  - alternately: 2 minutes' agitation 30 minutes' rest
  - Total treatment time: over night
  - Float: pH 4.0–4.2
  - Drain float Neutralization:
- 200% of water, 35° C.
- 2.0% of sodium formate
  - Agitate for 20 minutes
- \+ 2.0% of sodium bicarbonate
  - Agitate for 60 minutes
  - Float: pH 5.5–6.0

-continued

Drain float
Stuffing:
200.0% of water, 50° C.
12.0% of grease, e.g. natural and synthetic sulfoester compounds
Agitate for 90 minutes
Fixing:
+ 1.5% of formic acid, 85 percent, diluted 1:3
Agitate for 30 minutes
Drain float Washing, stretching of leather on horse, suspension drying, conventional finishing.

Example C-3: Vegetable Tanning

Leather type: light top leather
Starting material: trimmed wet-white, 1.4–1.5 mm
The percentages are based on the trimmed weight.

Washing:
300% of water, 35° C.
0.3% of surface active agent (TETRAPOL ® SAF)
Agitate for 20 minutes
Drain float
Tanning:
100.0% of water, 35° C.
4.0% of syntan (TANIGAN ® QF, a replacement tannin)
Agitate for 30 minutes
+ 3.0% of grease (CHROMOPOL ® SG, an electrolyte resistant tanning grease)
Agitate for 20 minutes
+ 8.0% of vegetable tanning agent (mimosa)
Agitate for 30 minutes
+ 3.0% syntan (TANIGAN ® BN, a synthetic tanning agent comprising phenol)
Agitate for 30 minutes
+ 0.5% of formic acid, 85 percent, diluted 1:3
Agitate for 30 minutes
alternately: 1 minute's agitation
10 minutes' rest
Total treatment time: over night
Drain float
Washing:
300.0% of water, 35° C.
Agitate for 10 minutes
Drain float
Neutralization:
150.5% of water, 35° C.
3.0% of neutralization tanning agent (TANIGAN ® PAK, a buffered synthetic neutralizing tanning agent)
Agitate for 45 minutes
Float: pH 5.0–5.5
Drain float
Washing:
300.0% of water, 40° C.
Agitate for 10 minutes
Drain float
Stuffing:
150.0% of water, 55° C.
18.0% of grease (CORIPOL ® MK, a grease especially for very soft clothing leather)
Agitate for 60 minutes
Fixing:
+ 2.0% of formic acid, 85 percent, diluted 1:3
Agitate for 30 minutes
Float: pH 3.5–3.7
Drain float
Washing:
Further treatment as described under A.

Example C-3a: Vegetable Retanning of the Chrome-free Pretanned Leather of Example C-1

Leather type: light top leather
Starting material: trimmed wet-white, 1.4–1.5 mm
The percentages are based on the trimmed weight.

Washing:
300.0% of water, 35° C.
0.3% of nonionic surface active and dispersing agent comprising fatty alcohol ethoxylates
Agitate for 20 minutes
Drain float
Tanning:
100.0% of water, 35° C.
4.0% of syntan, e.g. a phenol condensation product
Agitate for 30 minutes
+ 3.0% of grease, e.g. linear hydrocarbons
Agitate for 20 minutes
+ 8.0% of vegetable tanning agent, e.g. mimosa
Agitate for 180 minutes
+ 3.0% syntan, e.g. a phenol condensation product
Agitate for 30 minutes
+ 0.5% formic acid, 85 percent, diluted 1:3
Agitate for 30 minutes
alternately: 1 minutes of agitation
10 minutes of rest
Total treatment time: over night
Drain float
Washing:
300.0% of water, 35° C.
Agitate for 10 minutes
Drain float
Stuffing:
150.0% of water, 55° C.
8.0% of grease, e.g. sulfited oils
10.0% of grease, e.g. sulfosuccinic acid esters
Agitate for 60 minutes
Fixing:
+ 2.0% of formic acid, 85 percent, diluted 1:3
Agitate for 30 minutes
Float: pH 3.5–3.7
Drain float
Washing:
Further work as described under C-2.

Example C-4: Synthetic Tanning

Leather type: light top leather
Starting material: trimmed wet-white, 1.4–1.5 mm
The percentages are based on the trimmed weight.

Washing:
300.0% of water, 35° C.
0.3% of surface active agent (TETRAPOL ® SAF)
Agitate for 20 minutes
Drain float
Tanning:
100.0% of water, 30° C.
4.0% of syntan (TANIGAN ® QF, a replacement tannin)
Agitate for 30 minutes
+ 3.0% of grease (CHROMOPOL ® SG, an electrolyte resistant tanning grease)
Agitate for 20 minutes
+ 6.0% of syntan (TANIGAN ® BN, a synthetic tanning agent comprising phenol))
Agitate for 30 minutes
+ 6.0% of syntan (TANIGAN ® BN)
Agitate for 30 minutes
6.0% of syntan (IRGATAN ® FL, a condensation product of formaldehyde and aromatic oxisulfonic acids and sulfoacids)
Agitate for 180 minutes
alternately: 1 minute's agitation
30 minutes' rest
Total treatment time: over night
Drain float
Washing:
300.0% of water, 35° C.
Agitate for 10 minutes
Drain float
Neutralization:
150.0% of water, 35° C.

-continued 2.0% of neutralization tanning agent (TANIGAN ® PAK, a buffered synthetic neutralizing tanning agent)
Agitate for 30 minutes
+ 5.0% of syntan (IRGATAN ® FL, a condensation product of formaldehyde and aromatic oxysulfonic acids and sulfoacids))
Agitate for 60 minutes
Drain float Washing:
300.0% of water, 50° C.
Agitate for 10 minutes
Drain float Stuffing:
150.0% of water, 55° C.
18.0% of grease (CORIPOL ® MK, a grease especially for very soft clothing leather)
Agitate for 60 minutes Fixing:
+ 2.0% of formic acid, 85 percent, diluted 1:3
Agitate for 30 minutes
Float: pH 3.5–3.7
Drain float Washing:
Further work as described in C-2

Example C-4a: Synthetic Retanning of the Chrome-free Pretanned Leather of Example C-1

Leather type: light top leather
Starting material: trimmed wet-white, 1.4–1.5 mm
The percentages are based on the trimmed weight.

Washing:
300.0% of water, 35° C.
0.3% of nonionic surface active and dispersing agent comprising fatty alcohol ethoxylates
Agitate for 20 minutes
Drain float Tanning:
100.0% of water, 30° C.
4.0% of syntan, e.g. a phenol condensation product
Agitate for 30 minutes
+ 3.0% of grease, e.g. linear hydrocarbons
Agitate for 20 minutes
+ 6.0% of syntan, e.g. a phenol condensation product
Agitate for 30 minutes
+ 6.0% syntan, e.g. a phenol condensation product
Agitate for 30 minutes
+ 6.0% of syntan, e.g. a phenol condensation product
Agitate for 180 minutes
alternately: 1 minute's agitation
30 minutes' rest
Total treatment time: over night
Drain float Washing:
300.0% of water, 35° C.
Agitate for 10 minutes
Drain float Neutralization:
150.0% of water, 35° C.
2.0% of neutralization tanning agent, e.g. salts of organic acids
Agitate for 30 minutes
+ 5.0% of syntan, e.g. a phenol condensation product
Agitate for 60 minutes
Drain float Washing:
300.0% of water, 50° C.
Agitate for 10 minutes
Drain float Stuffing:
150.0% of water, 55° C.
8.0% of grease, e.g. sulfited oils
10.0% of grease, e.g. sulfosuccinic acid esters
Agitate for 60 minutes Fixing:
+ 2.0% of formic acid, 85 percent, diluted 1:3
Agitate for 30 minutes
Float: pH 3.5–3.7
Drain float Washing:
Further work as described in C-2

The leather shrinking temperature is determined according to standard method IUP 16 developed by the International Union of Leather Technicians and Chemists (IULTC), (c.f. Ullmann's Encyclopedia of Industrial Chemistry, 5th Ed. Vol. A15, 280–281 VCH 1990; Ullmann's Encyclop ädie der Techn. Chemie, 4. Aufl. Bd. 16, 170–177 Verlag Chemie 1978).

The results obtained in Examples C-1 to C-4 are discussed in the following:

Examples C-1/C-1a:

Leather pretanned according to those examples has a shrinking temperature up to four degrees centigrade higher than leather tanned with glutardialdehyde in a conventional manner. They also are more readily milled (dewatered).

Examples C-2/C-2a:

Leather tanned with chrome according to example C-2 show a distinctly superior distribution of the chrome in the cross-section of the hides as compared with leather that had been pretanned with glutardialdehyde only and was tanned with chrome as described in the example. Moreover the color distribution is particularly equal and uniform. The shrinking temperature of the crust leather is distinctly higher than the shrinking temperature of leather that was pretanned with glutardialdehyde only.

Examples C-3/C-3a:

Leather, which was retanned with vegetable tanning agents according to examples C-3/C-3a showed particularly good fullness and a solid grain. This is held to be a consequence of the uniform distribution of vegetable tanning agents throughout the cross section of the hides. In this case, too the shrinking temperature is from 2° to 4° centigrade higher.

Examples C-4/C-4a:

Similar to examples C-3/C-3a a more uniform and equal distribution of synthetic tanning agents throughout the cross sections of the hide is observed.

The result is a better fullness particularly in the axila section of the hides. The color is more equal.

Due to the high uptake of the tanning agent the concentration actually employed can be reduced by about 20–30 percent compared with glutaraldehyde tanning of leather.

The same holds for vegetable tanning agents in analogy to examples c-3/C-3a.

TABLE 3

| | | | COMPARED PROPERTIES OF THE TANNING AGENTS TA | | | | |
|---|---|---|---|---|---|---|---|
| | AMOUNT | SHRINKAGE TEMPERATURE | | | FINISHED LEATHER (CRUST) | | |
| TA | (WT. -%) | (°C.) | WET-WHITE COLOR | TRIMABILITY | SOFTNESS | FULLNESS | COLOR[1] |
| I | 2.18 | 70.5 | bright | good | good | good | bright |
| II | 1.47 | 68.5 | bright | good | good | moderate | very bright |
| III | 2.15 | 72.0 | bright | good | good | moderate | bright |
| IV | 1.46 | 72.5 | bright | good | good | very good | yellowish-bright |
| V | 1.99 | 71.0 | bright | good | good | very good | yellowish-bright |
| VI | 1.98 | 72.0 | bright | good | very good | good | bright |

[1]In order to observe the influence of the tanning agent on the impartation of color, there was no addition of a dye.

What is claimed is:

1. A tanning agent comprising as the active tanning agent an ω,ω'-dialdehyde of the formula $$O{=}CH\text{-}(CH)_r\text{-}HC{=}O,$$

wherein r is an integer from 2 to 8, and a polymer containing hydroxyl groups which is made up of a') 0 to 10 percent by weight of at least one carboxylic monomer of the formula $$R_2HC{=}C(R_1)\text{-}COOH,$$

wherein $R_1$ is hydrogen, methyl, or a $-CH_2COOH$ group and $R_2$ is hydrogen, methyl, phenyl, or a -COOH group but where there are not more than two carboxyl groups in the molecule, or of at least one anhydride monomer of the formula

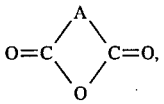

wherein A is the group $$\begin{array}{l} HC{=}CH \\ \;\;|\qquad\;\; | \end{array}$$

or the group $$\begin{array}{l} H_2C{=}C{-}CH_2{-}, \\ \qquad\;\; | \end{array}$$

and b') 0 to 10 percent by weight of at least one hydroxylic monomer of the formula $$CH_2{=}\overset{\overset{R_3}{|}}{C}{-}\overset{\overset{O}{||}}{C}{-}OR_4,$$

wherein $R_3$ is hydrogen or methyl and $R_4$ is an alkyl or cycloalkyl group having 1 to 12 carbon atoms substituted with at least one hydroxyl group, and c') 90 to 100 percent by weight of at least one allyloxy ester monomer of the formula $$CH_2{=}CH{-}O{-}\overset{\overset{O}{||}}{C}R_5,$$

wherein $R_5$ is an alkyl group having 1 or 2 carbon atoms, and d') 0 to 10 percent by weight of at least one (meth)acrylic acid ester monomer of the formula $$H_2C{=}\overset{\overset{R'_3}{|}}{C}{-}COOR_6,$$

wherein $R'_3$ is hydrogen or methyl and $R_6$ is an alkyl or cycloalkyl group having 1 to 12 carbon atoms.

2. A tanning agent as in claim 1 wherein the dialdehyde is present in deactivated form.

3. A tanning agent as in claim 1 wherein the weight ratio of the dialdehyde to the polymer is from 1:4 to 4:1.

4. A tanning agent as in claim 1 which additionally contains at least one alcohol.

5. A tanning agent as in claim 4 wherein the alcohol is present in a mol ratio from 1:1 to 2:1 with respect to the dialdehyde.

6. A tanning agent as in claim 1 present in an aqueous formulation containing 10 to 60 percent by weight of polymer.

* * * * *